US011351564B1

(12) United States Patent
Drewett

(10) Patent No.: US 11,351,564 B1
(45) Date of Patent: Jun. 7, 2022

(54) ROTATABLE SPRAY GUN LIGHT

(71) Applicant: Lockheed Martin Corporation, Bethesda, MD (US)

(72) Inventor: Jeffrey T. Drewett, Kennedale, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 17/361,874

(22) Filed: Jun. 29, 2021

(51) Int. Cl.

| | |
|---|---|
| ***B05B 15/00*** | (2018.01) |
| ***B05B 9/01*** | (2006.01) |
| ***F21S 9/02*** | (2006.01) |
| ***F21V 23/00*** | (2015.01) |
| *F21Y 115/10* | (2016.01) |

(52) U.S. Cl.
CPC ..... *B05B 15/00* (2013.01); *B05B 9/01* (2013.01); *F21S 9/02* (2013.01); *F21V 23/001* (2013.01); *F21Y 2115/10* (2016.08)

(58) Field of Classification Search
CPC ..... B05B 15/00; B05B 9/01; F21S 9/02; F21V 23/001; F21Y 215/10
See application file for complete search history.

(56) References Cited

U.S. PATENT DOCUMENTS

| | | | | |
|---|---|---|---|---|
| 4,291,839 | A * | 9/1981 | Brett | B05B 15/00 239/289 |
| 5,857,625 | A | 1/1999 | Klein et al. | |
| 5,873,647 | A | 2/1999 | Kurtz et al. | |
| 7,244,464 | B2 | 7/2007 | Robens et al. | |
| 9,409,196 | B1 * | 8/2016 | Lucas | F21V 33/00 |
| 10,639,658 | B1 * | 5/2020 | Enriquez | B05B 9/01 |
| 2018/0085763 | A1 * | 3/2018 | Leckner | B05B 1/30 |
| 2018/0195657 | A1 * | 7/2018 | Hafele | F21S 4/10 |
| 2018/0274778 | A1 * | 9/2018 | Fulkerson | B05B 5/025 |

FOREIGN PATENT DOCUMENTS

| | | | |
|---|---|---|---|
| CN | 205217185 | | 5/2016 |
| CN | 205341132 | | 6/2016 |
| CN | 208390288 | | 1/2019 |
| CN | 110038744 | A * | 7/2019 |
| CN | 209317952 | | 8/2019 |
| DE | 29717126 | | 11/1997 |
| JP | 4922378 | B2 | 2/2012 |
| KR | 101840394 | B1 | 3/2018 |
| TW | M 271626 | | 5/2005 |

OTHER PUBLICATIONS

"Luma III Aurora 2 Paint Gun Light," Luma III Inc. © 2012-2019, Apr. 13, 2020.

* cited by examiner

*Primary Examiner* — Anabel Ton
(74) *Attorney, Agent, or Firm* — Baker Botts L.L.P.

(57) ABSTRACT

In one embodiment, a spray gun light includes an aperture configured to allow the spray gun light to attach over an air cap of a spray gun. The spray gun light also includes multiple horn clips. Each horn clip is configured to couple to a respective horn of a plurality of horns of the air cap of the spray gun. The spray gun light also includes a plurality of lights that include a first light configured to shine light along a first side of a spray plume generated by the air cap, and a second light configured to shine light on along a second side of the spray plume that is opposite the first side. The spray gun light is configured to rotate along with the air cap as the air cap is rotated, thereby preventing light from the plurality of lights from being blocked by the spray plume.

19 Claims, 7 Drawing Sheets

ROTATABLE SPRAY GUN LIGHT

TECHNICAL FIELD

This disclosure generally relates to spray guns and more specifically to a rotatable spray gun light.

BACKGROUND

Spray guns are used for many different applications in many different industries. As one example, automobile repair facilities utilize spray guns to apply paint to automobile body parts. As another example, aircraft manufacturers use spray guns to apply coatings such as paint to various components of aircraft. The spray plumes of spray guns sometimes make it difficult for operators to see the area they are spraying.

SUMMARY OF PARTICULAR EMBODIMENTS

In one embodiment, a spray gun light includes an aperture configured to allow the spray gun light to attach over an air cap of a spray gun. The spray gun light also includes a plurality of horn clips. Each horn clip is configured to couple to a respective horn of a plurality of horns of the air cap of the spray gun. The spray gun light also includes a plurality of lights that include a first light configured to shine light along a first side of a spray plume generated by the air cap, and a second light configured to shine light on along a second side of the spray plume that is opposite the first side. The spray gun light is configured to rotate along with the air cap as the air cap is rotated, thereby preventing light from the plurality of lights from being blocked by the spray plume.

In another embodiment, a system includes a battery pack and a spray gun light electrically coupled to the battery back. The spray gun light includes an aperture configured to allow the spray gun light to attach over an air cap of a spray gun. The spray gun light also includes a plurality of horn clips. Each horn clip is configured to couple to a respective horn of a plurality of horns of the air cap of the spray gun. The spray gun light also includes a plurality of lights that include a first light configured to shine light along a first side of a spray plume generated by the air cap, and a second light configured to shine light on along a second side of the spray plume that is opposite the first side. The spray gun light is configured to rotate along with the air cap as the air cap is rotated, thereby preventing light from the plurality of lights from being blocked by the spray plume.

In another embodiment, a spray gun light includes a first plurality of lights and a second plurality of lights. The first plurality of lights are configured to shine light along a first side of a spray plume generated by an air cap of a spray gun. The second plurality of lights are configured to shine light along a second side of the spray plume that is opposite the first side. The spray gun light is configured to rotate along with the air cap as the air cap is rotated, thereby preventing light from the first and second plurality of lights from being blocked by the spray plume.

The present disclosure provides numerous technical advantages over existing spray gun lighting. As one example, the disclosed rotatable spray gun lights are configured to attach to an air cap of a spray gun and are configured to rotate along with the air cap as the air cap is rotated by the operator. The rotatable spray gun lights include multiple lights that are each configured to shine light along the opposite sides of a spray plume generated by the air cap. Because the rotatable spray gun light rotates along with the air cap as the air cap is rotated, the spray plume never blocks the lights of the rotatable spray gun light. This increases the efficiency of the spray gun and decreases operation time.

Other technical advantages will be readily apparent to one skilled in the art from the following figures, descriptions, and claims. Moreover, while specific advantages have been enumerated herein, various embodiments may include all, some, or none of the enumerated advantages.

DESCRIPTION OF EXAMPLE EMBODIMENTS

Spray guns are used for many different applications in many different industries. As one example, automobile repair facilities utilize spray guns to apply paint to automobile body parts. As another example, aircraft manufacturers use spray guns to apply coatings such as paint to various components of aircraft. The spray plumes of spray guns sometimes make it difficult for operators to see the area they are spraying. For example, when an operator rotates an air cap of the spray gun in order to rotate the spray plume generated by the air gun, the spray plume may block any existing lights from the air gun. This may reduce visibility and reduce efficiency of the air gun.

To address these and other problems with typical spray guns, the disclosed embodiments provide rotatable spray gun lights that are configured to attach to an air cap of a spray gun and are configured to rotate along with the air cap as the air cap is rotated by the operator. The rotatable spray gun light includes multiple lights that are each configured to shine light along the opposite sides of a spray plume generated by the air cap. Because the rotatable spray gun light rotates along with the air cap as the air cap is rotated, the spray plume never blocks or interferes with the lights of the rotatable spray gun light (i.e., the lights of the rotatable spray gun light never shine through the spray plume). This increases the efficiency of the spray gun and decreases operation time.

To facilitate a better understanding of the present disclosure, the following examples of certain embodiments are given. In no way should the following examples be read to limit or define the scope of the disclosure. Embodiments of the present disclosure and its advantages may be best understood by referring to the included FIGURES, where like numbers are used to indicate like and corresponding parts.

Figure 1A:
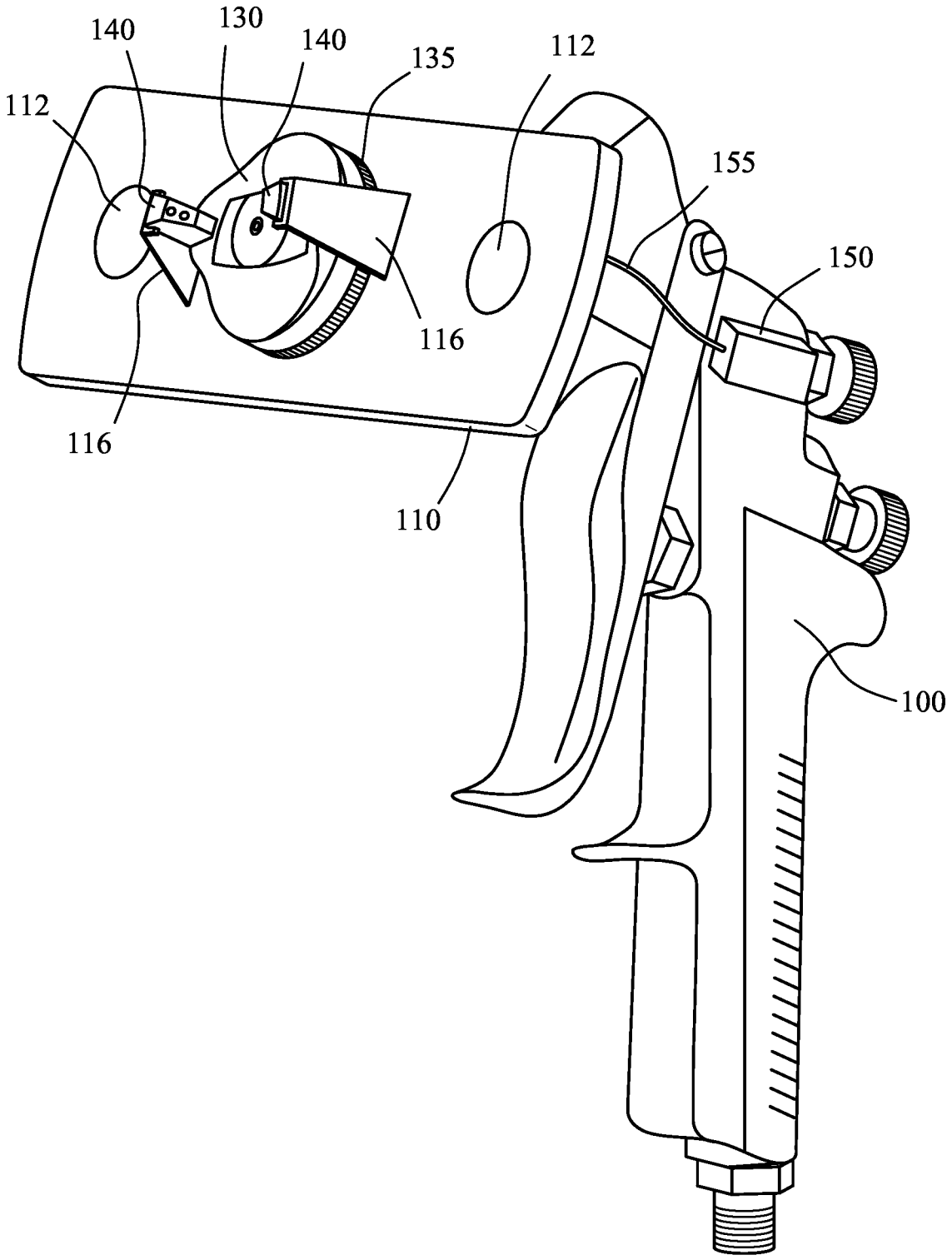
FIG. 1A illustrates a rotatable spray gun light installed on a spray gun, according to certain embodiments.
Figure 1B:
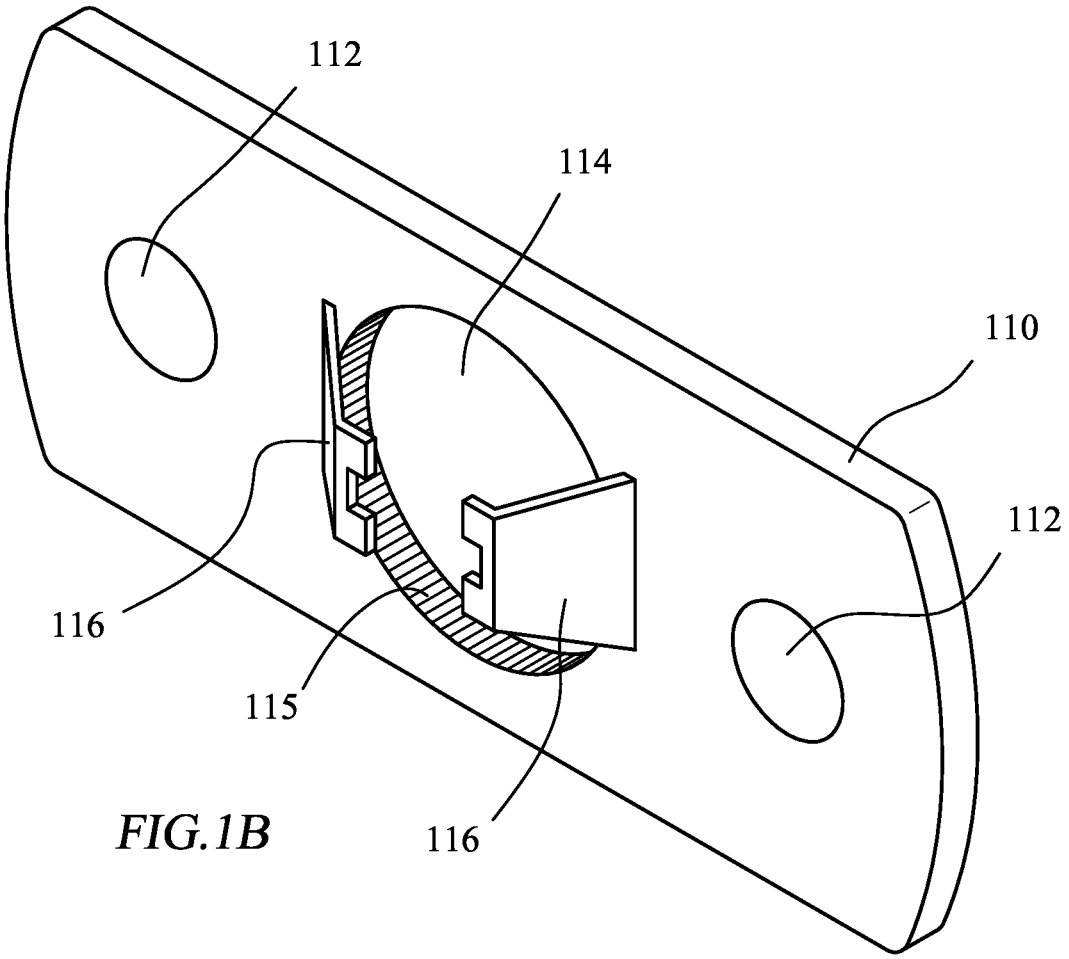
FIG. 1B illustrates a perspective view of the rotatable spray gun light of FIG. 1A, according to certain embodiments.
Figure 1C:
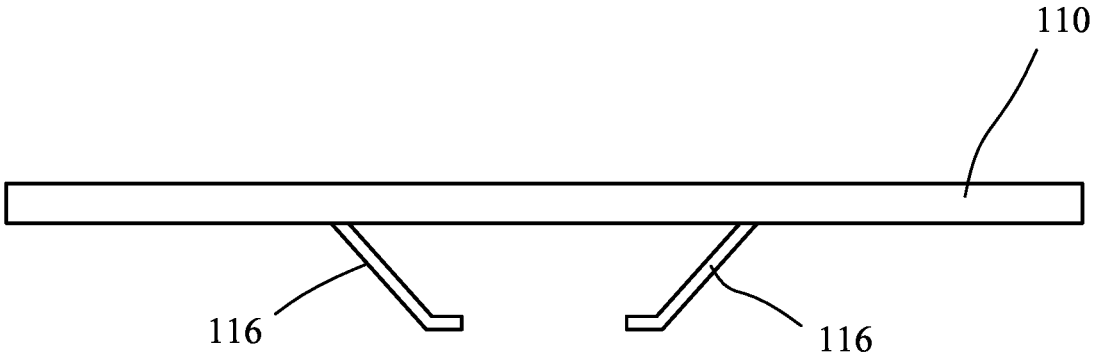
FIG. 1C illustrates a top-down view of the rotatable spray gun light of FIG. 1A, according to certain embodiments.
Figure 2A:
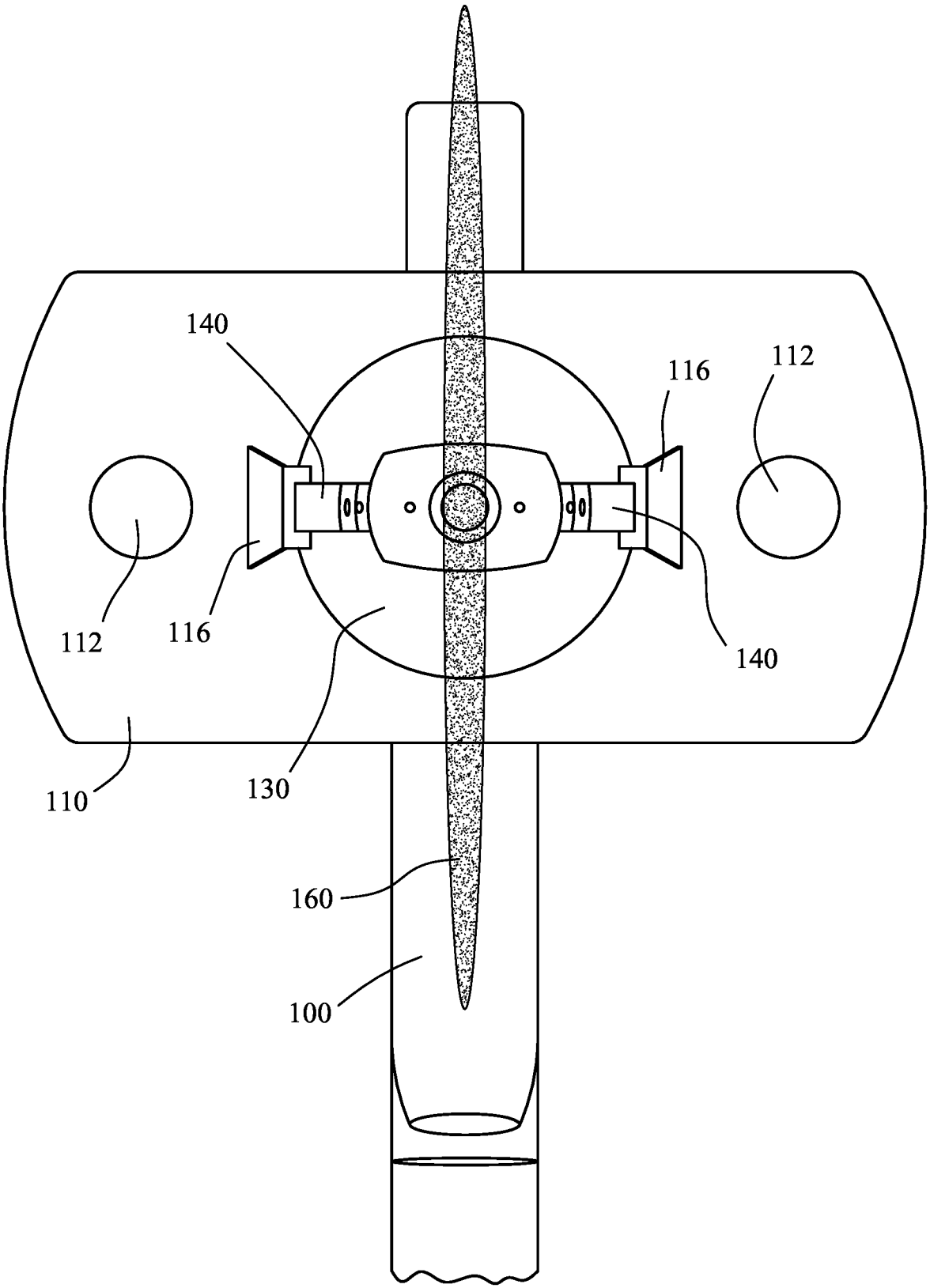
FIG. 2A illustrates a front view of the rotatable spray gun light of FIG. 1A, according to certain embodiments.
Figure 2B:
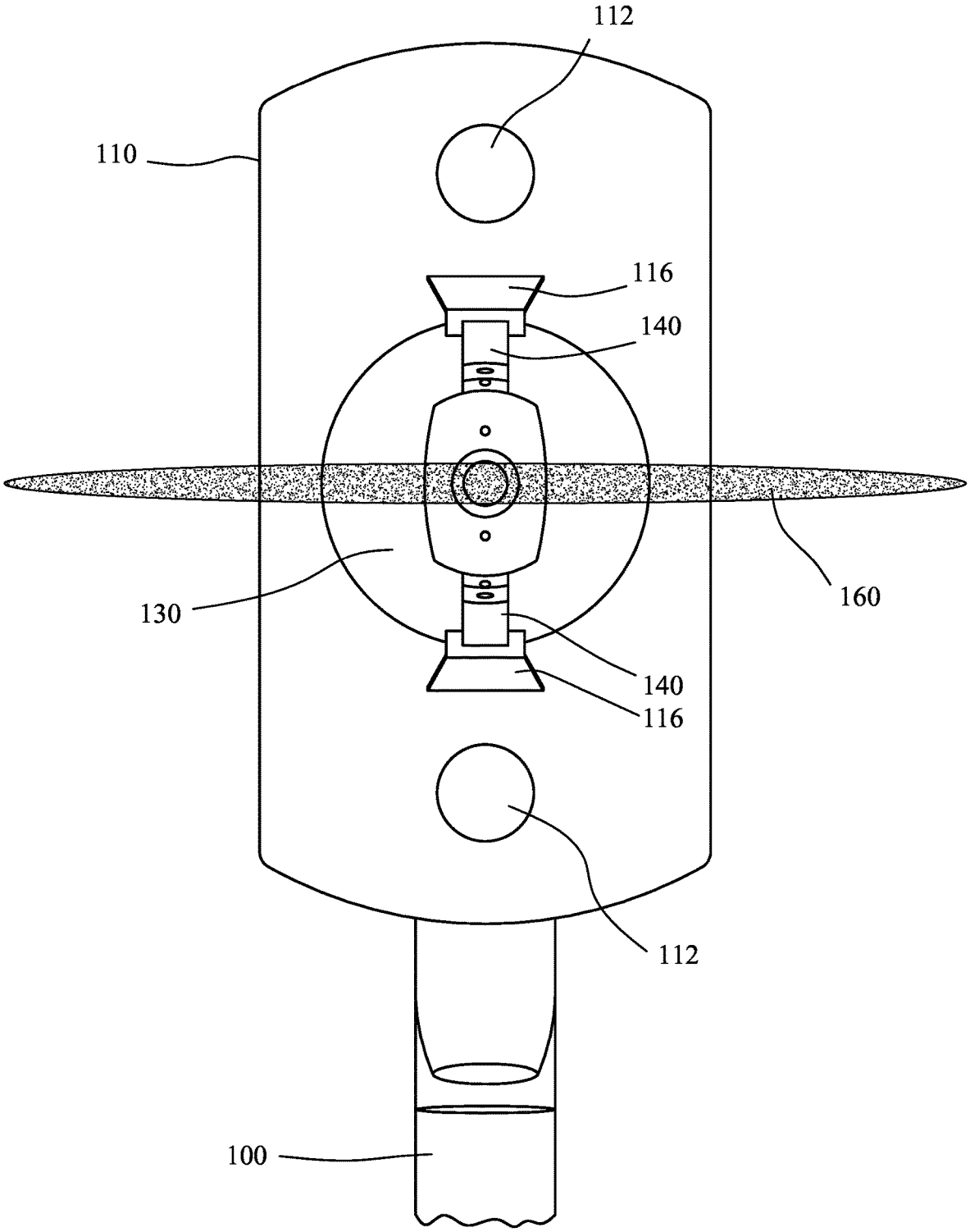
FIG. 2B illustrates another front view of the rotatable spray gun light of FIG. 1A, according to certain embodiments.

Certain embodiments of a rotatable spray gun light 110 will now be described in reference to FIGS. 1A-2B. FIG. 1A illustrates a rotatable spray gun light 110 installed on a spray gun 100; FIG. 1B illustrates a perspective view of the rotatable spray gun light 110 of FIG. 1A; FIG. 1C illustrates a top-down view of the rotatable spray gun light 110 of FIG. 1A; and FIGS. 2A-2B illustrate front views of the rotatable spray gun light 110 of FIG. 1A, according to certain embodiments. As illustrated in these figures, rotatable spray gun light 110 includes multiple lights 112, an air cap aperture 114, and horn clips 116. Rotatable spray gun light 110 is coupled to a battery pack 150 via a battery cable 155. Battery pack 150 supplies the electrical power needed to power lights 112. In general, rotatable spray gun light 110 illuminates a work area for spray gun 100 (e.g., an object being sprayed by spray gun 100). Lights 112 are located on sides of a spray plume 160 generated by spray gun 100. Since rotatable spray gun light 110 rotates along with air cap 130, spray plume 160 is prevented from blocking or interfering with light from lights 112, thereby preventing frustration and improving performance and efficiency of spray gun 100.

Lights 112 are any appropriate lights for illuminating a work area for spray gun 100. In some embodiments, lights 112 are LED lights. In other embodiments, lights 112 are incandescent lights. In general, lights 112 are located between the side edges of rotatable spray gun light 110 and horn clips 116 (described further below) such that light from lights 112 shine down the sides of spray plume 160. Lights 112 may be in any appropriate shape or configuration. For example, as illustrated in FIGS. 1A-2B, some embodiments of rotatable spray gun light 110 may include two round LED lights 112—one on each side of spray plume 160 (i.e., one proximate to one of the horn clips 116, and another proximate to the other horn clip 116). Other configurations of lights 112 are discussed below in reference to FIGS. 3A-3B.

Air cap aperture 114 is an appropriately sized and shaped aperture to allow rotatable spray gun light 110 to attach over air cap 130 of spray gun 100. In some embodiments, air cap aperture 114 is circular in shape. In some embodiments, air cap aperture 114 may include grooves 115 that interlock with grooves 135 of air cap 130, thereby securing rotatable spray gun light 110 to air cap 130 of spray gun 100.

Horn clips 116 are any appropriate protrusions or fasteners that permit spray gun 100 to attach to air cap 130. Typically, air cap 130 of spray gun 100 includes two horns 140 as illustrated in FIG. 1A. Each horn 140 is located on a respective side of spray plume 160 and include apertures through which spray gun 100 forces air for forming spray plume 160. Each horn clip 116 may be appropriately shaped to clip to a horn 140, thereby securing rotatable spray gun light 110 to air cap 130. For example, horn clips 116 may be protrusions that protrude away from a surface of rotatable spray gun light 110 and are semi-flexible for allowing horn clips 116 to be clipped to horns 140. Since horns 140 are on respective sides of spray plume 160, and horn clips 116 attach rotatable spray gun light 110 to air cap 130, rotatable spray gun light 110 is automatically configured to shine light down the sides of spray plume 160.

Battery pack 150 stores any appropriate batteries for powering lights 112 of rotatable spray gun light 110. Battery pack 150 may include any fastening apparatus for fastening battery pack 150 to any part of spray gun 100. For example, battery pack 150 may be fastened or otherwise secured to spray gun 100 using clips, screws, Velcro, double-sided tape, or any other appropriate fastening apparatus. Battery pack 150 supplies electrical power to rotatable spray gun light 110 via battery cable 155. Battery cable 155 may be any appropriate length to allow rotatable spray gun light 110 to rotate along with air cap 130 as air cap 130 is rotated.

In operation, rotatable spray gun light 110 is placed over air cap 130 (i.e., air cap 130 slides through air cap aperture 114) and is secured to air cap 130 using horn clips 116. In some embodiments, grooves 115 of air cap aperture 114 interlock with grooves 135 of air cap 130, thereby securing rotatable spray gun light 110 to air cap 130 and preventing rotatable spray gun light 110 from freely rotating around air cap 130. Rotatable spray gun light 110 is coupled to battery pack 150 using battery cable 155. In some embodiments, rotatable spray gun light 110 includes an on/off switch (not pictured) that allows rotatable spray gun light 110 to be turned on/off. Once activated, lights 112 of rotatable spray gun light 110 shine light down respective sides of spray plume 160 in order to illuminate an object being sprayed by spray gun 100. For example, as illustrated in FIG. 2A, light 112 on the left side of rotatable spray gun light 110 shines light down the left side of spray plume 160 (i.e., the "first" side), and light 112 on the right side of rotatable spray gun light 110 shines light down the right side of spray plume 160 (i.e., the "second" side that is opposite the first side). As air cap 130 is rotated (e.g., FIG. 2B), rotatable spray gun light 110 rotates along with air cap 130, thereby preventing spray plume 160 from blocking light from lights 112.

Figure 3A:
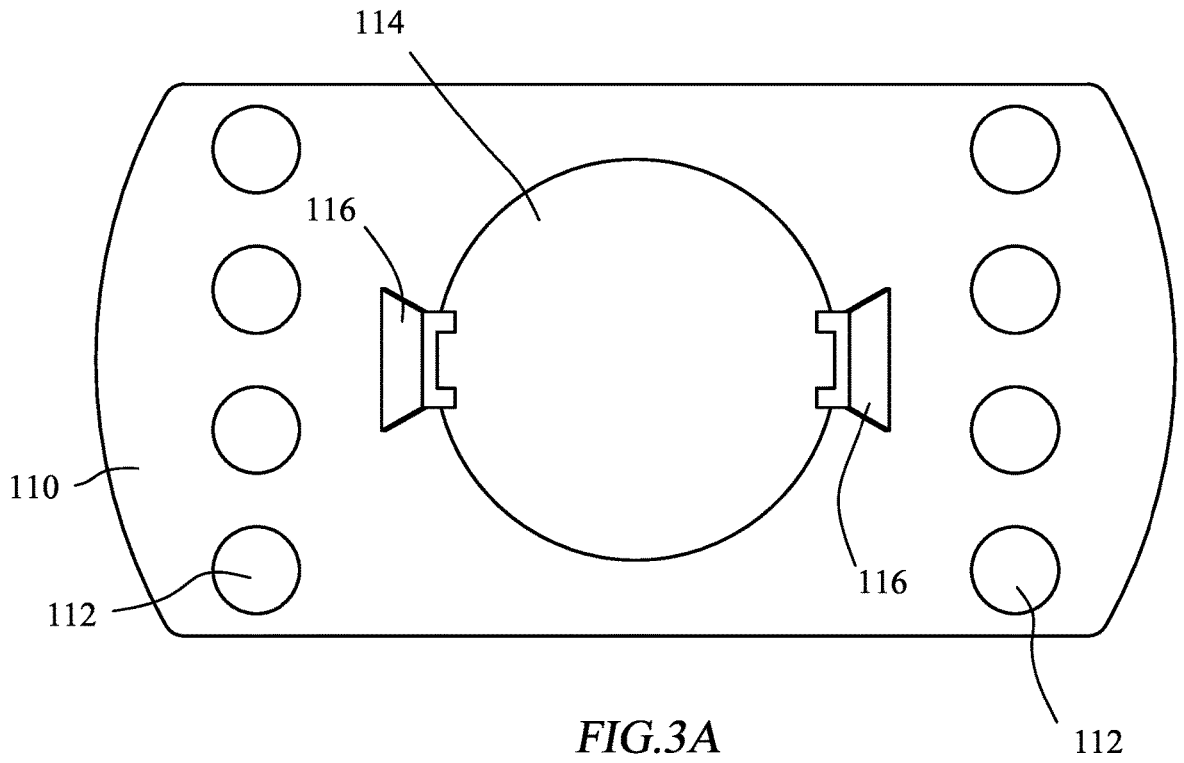
FIGS. 3A and 3B illustrate alternate configurations of the rotatable spray gun light of FIG. 1A, according to certain embodiments.
Figure 3B:
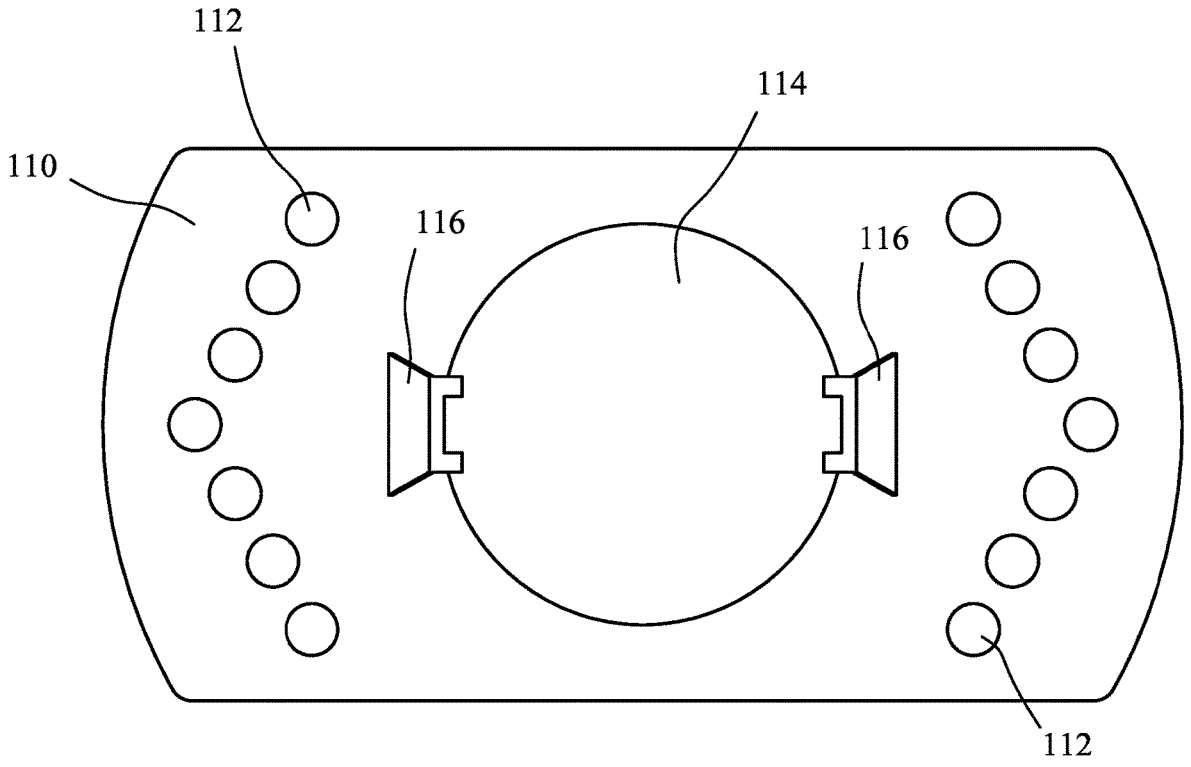

Certain alternate embodiments of rotatable spray gun light 110 will now be described in reference to FIGS. 3A-3B. FIG. 3A illustrates a rotatable spray gun light 110 that includes four lights 112 on each side of spray plume 160. The four lights 112 on the left side of rotatable spray gun light 110 (i.e., between the left side of rotatable spray gun light 110 and the left horn clip 116) are configured to shine light along a first side of the spray plume (i.e., the left side), and the four lights 112 on the right side of rotatable spray gun light 110 (i.e., between the right side of rotatable spray gun light 110 and the right horn clip 116) are configured to shine light along a second side of the spray plume (i.e., the right side). Similarly, FIG. 3B illustrates a rotatable spray gun light 110 that includes seven lights 112 on each side of spray plume 160. The seven lights 112 on the left side of rotatable spray gun light 110 (i.e., between the left side of rotatable spray gun light 110 and the left horn clip 116) are configured to shine light along a first side of the spray plume (i.e., the left side), and the seven lights 112 on the right side of rotatable spray gun light 110 (i.e., between the right side of rotatable spray gun light 110 and the right horn clip 116) are configured to shine light along a second side of the spray plume (i.e., the right side). As illustrated in these figures, lights 112 may be arranged together in any appropriate pattern. For example, lights 112 in FIG. 3A are arranged in a straight-line pattern, and the lights 112 in FIG. 3B are arranged in an arrow pattern. Any appropriate pattern may be used (e.g., a curved line, a square, a rectangle, a triangle, a circle, and the like). In some embodiments, the pattern of lights 112 of the left side of rotatable spray gun light 110 mirrors the pattern of the lights 112 on the right side of rotatable spray gun light 110 as illustrated in FIG. 3B.

Figure 4A:
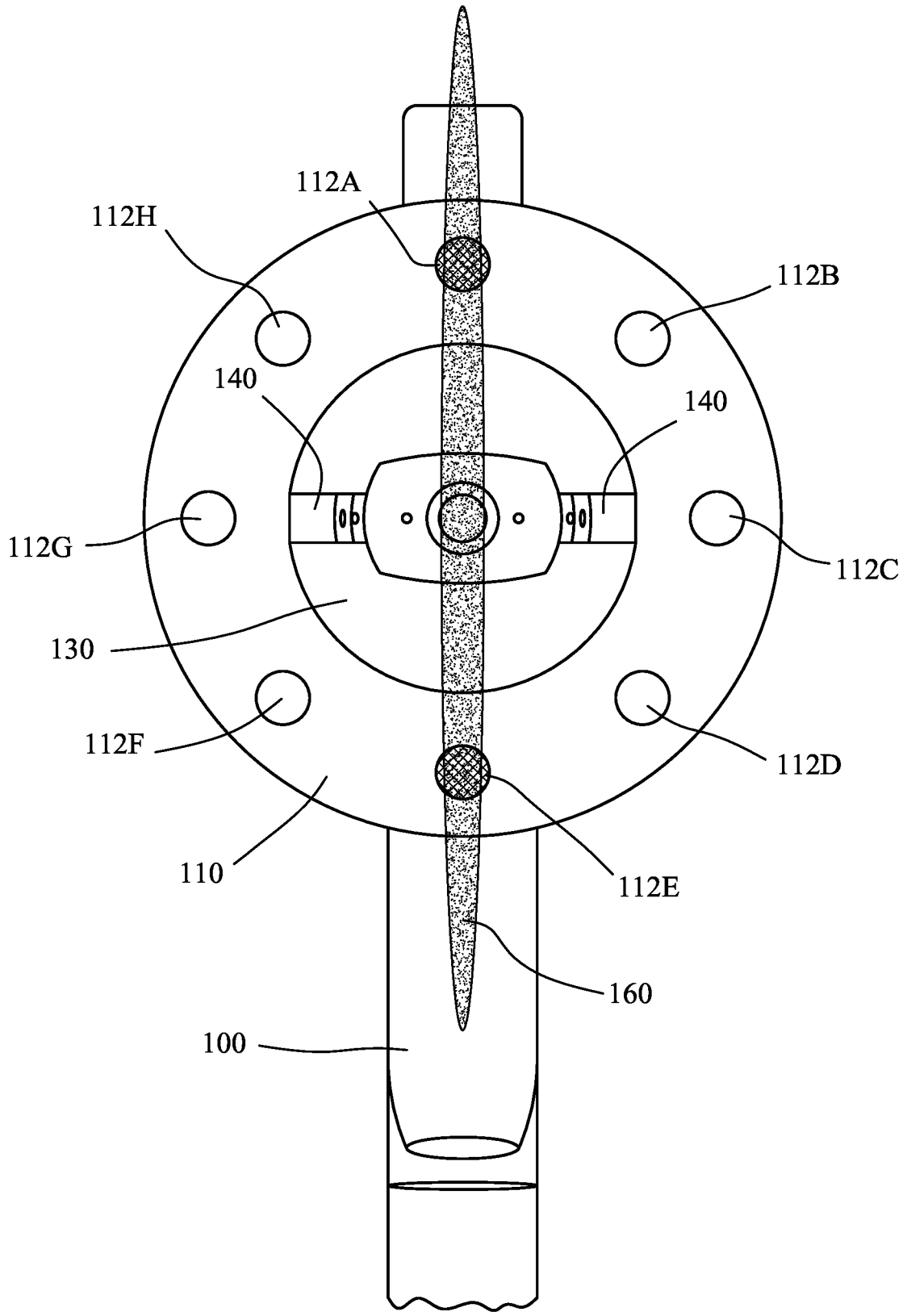
FIG. 4A illustrates a front view of another embodiment of a rotatable spray gun light installed on a spray gun, according to certain embodiments.
Figure 4B:
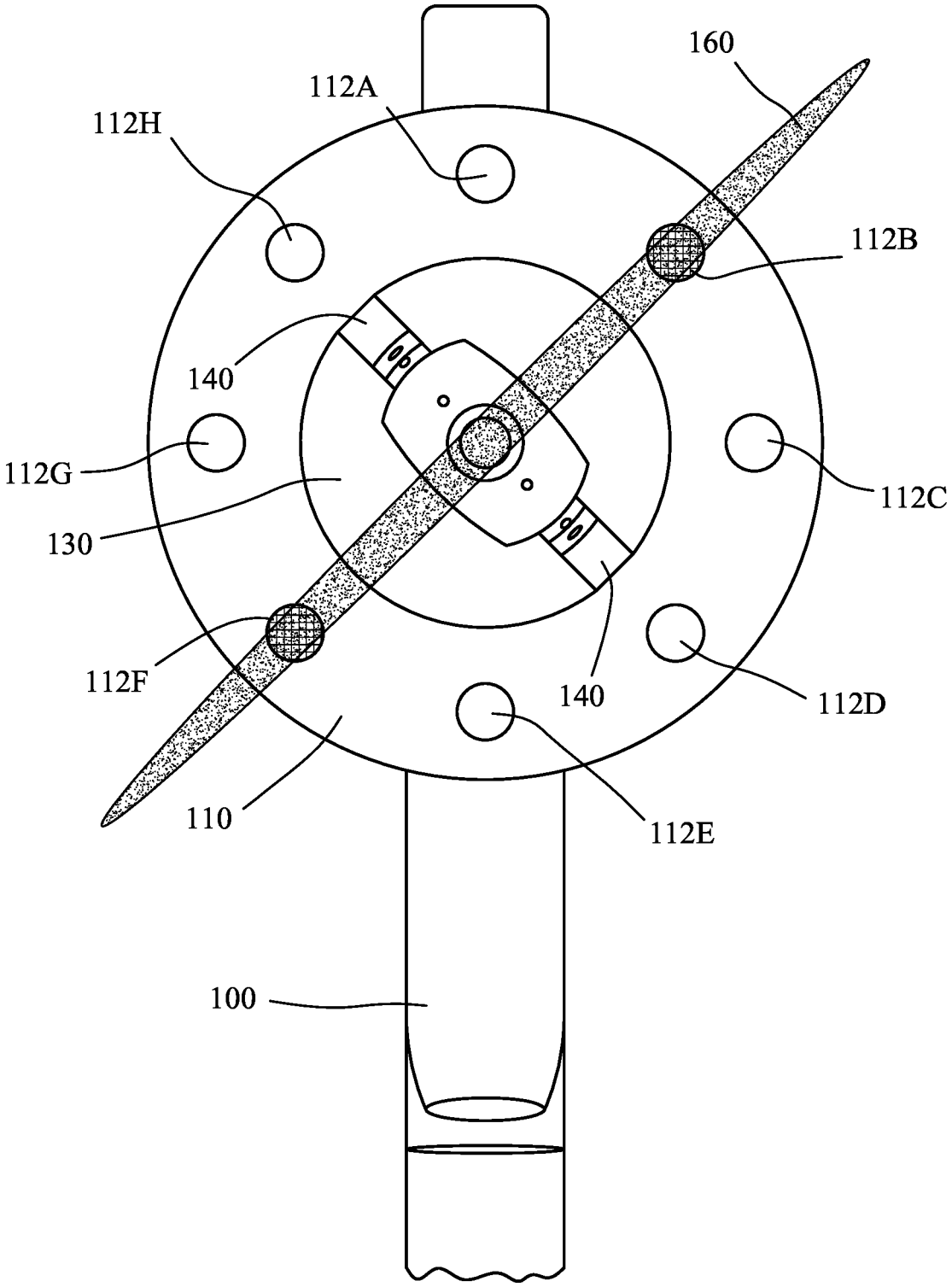
FIG. 4B illustrates another front view of the rotatable spray gun light of FIG. 4A, according to certain embodiments.

FIGS. 4A and 4B illustrate front views of another embodiment of rotatable spray gun light 110, according to certain embodiments. In this embodiment, rotatable spray gun light 110 is formed in a circular shape and includes lights 112 (i.e., 112A-112G) formed in a circular shape around the edge of rotatable spray gun light 110. Unlike the previous embodiments of rotatable spray gun light 110, rotatable spray gun light 110 of FIGS. 4A-4B does not rotate along with air cap 130. Instead, rotatable spray gun light 110 of these figures is affixed to spray gun 100 in any appropriate manner to prevent rotatable spray gun light 110 from rotating along with air cap 130. For example, rotatable spray gun light 110 of these figures may not include horn clips 116 but instead use spring tension and friction around air cap 130 or a lock ring of spray gun 100 that enables rotatable spray gun light 110 to be rotated manually (i.e., rotatable spray gun light 110 is not affixed to horns 140 with horn clips 116), thus allowing adjustment of rotatable spray gun light 110 independent from adjustment of air cap 130. To avoid having spray plume 160 block lights 112A-112G, rotatable spray gun light 110 of FIGS. 4A-4B includes a sensor (not illustrated) to sense the rotation of air cap 130 or the position of spray plume 160 and then automatically turn off any lights 112A-112G that may be blocked by spray plume 160. For example, as illustrated in FIG. 4A, rotatable spray gun light 110 has sensed that spray plume 160 is blocking lights 112A and 112E and has accordingly turned off these lights while keeping the remaining lights 112 activated. Similarly, as illustrated in FIG. 4B, rotatable spray gun light 110 has sensed that spray plume 160 is blocking lights 112B and 112F and has accordingly turned off these lights while keeping the remaining lights 112 activated. Any appropriate position sensor may be used in these embodiments (e.g., potentiometric position sensor (resistance-based), inductive position sensor, eddy current-based position sensor, capacitive position sensor, magnetostrictive position sensor, hall effect-based magnetic position sensor, fiber-optic position sensor, optical position sensor, ultrasonic position sensor, and the like).

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, functions, operations, or steps, any of these embodiments may include any combination or permutation of any of the components, elements, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A spray gun light comprising:

an aperture configured to allow the spray gun light to attach over an air cap of a spray gun:

a plurality of horn clips, each horn clip configured to couple to a respective horn of a plurality of horns of the air cap of the spray gun; and a plurality of lights comprising:

a first light configured to shine light along a first side of a spray plume generated by the air cap; and a second light configured to shine light on along a second side of the spray plume that is opposite the first side;

wherein the spray gun light is configured to rotate along with the air cap as the air cap is rotated, thereby preventing light from the plurality of lights from being blocked by the spray plume.

2. The spray gun light of claim 1, further comprising an electrical cable configured to supply electrical power to the spray gun light from a battery that is separate from the spray gun light.

3. The spray gun light of claim 1, further comprising a third light, a fourth light, a fifth light, a sixth light, a seventh light, and an eighth light, wherein:

the first, third, fourth, and fifth lights are configured to shine light along the first side of the spray plume; and the second, sixth, seventh, and eighth lights are configured to shine light along the second side of the spray plume.

4. The spray gun light of claim 3, wherein:

the first, third, fourth, and fifth lights are arranged together in a pattern; and the second, sixth, seventh, and eighth lights are arranged together in the pattern.

5. The spray gun light of claim 4, wherein the pattern comprises:

a straight line;

a curved line;

an arrow;

a square;

a rectangle;

a triangle; or a circle.

6. The spray gun light of claim 1, wherein the aperture comprises a plurality of grooves.

7. The spray gun light of claim 1, wherein the plurality of lights are LED lights.

8. The spray gun light of claim 1, wherein the plurality of horn clips are protrusions that protrude away from a surface of the spray gun light.

9. A system comprising:

a battery pack; and a spray gun light electrically coupled to the battery back, the spray gun light comprising:

an aperture configured to allow the spray gun light to attach over an air cap of a spray gun:

a plurality of horn clips, each horn clip configured to couple to a respective horn of a plurality of horns of the air cap of the spray gun; and a plurality of lights comprising:

a first light configured to shine light along a first side of a spray plume generated by the air cap; and a second light configured to shine light on along a second side of the spray plume that is opposite the first side;

wherein the spray gun light is configured to rotate along with the air cap as the air cap is rotated, thereby preventing light from the plurality of lights from being blocked by the spray plume.

10. The system of claim 9, the spray gun light further comprising an electrical cable configured to supply electrical power to the spray gun light from the battery pack.

11. The system of claim 9, the spray gun light further comprising a third light, a fourth light, a fifth light, a sixth light, a seventh light, and an eighth light, wherein:

the first, third, fourth, and fifth lights are configured to shine light along the first side of the spray plume; and the second, sixth, seventh, and eighth lights are configured to shine light along the second side of the spray plume.

12. The system of claim 11, wherein:

the first, third, fourth, and fifth lights are arranged together in a pattern; and the second, sixth, seventh, and eighth lights are arranged together in the pattern.

13. The system of claim 12, wherein the pattern comprises:

a straight line;

a curved line;

an arrow;

a square;

a rectangle;

a triangle; or a circle.

14. The system of claim 9, wherein the aperture comprises a plurality of grooves.

15. The system of claim 9, wherein the plurality of lights are LED lights.

16. The system of claim 9, wherein the plurality of horn clips are protrusions that protrude away from a surface of the spray gun light.

17. A spray gun light comprising:

a first plurality of lights configured to shine light along a first side of a spray plume generated by an air cap of a spray gun;

a second plurality of lights configured to shine light along a second side of the spray plume that is opposite the first side; and an electrical cable configured to supply electrical power to the spray gun light from a battery that is separate from the spray gun light;

wherein the spray gun light is configured to rotate along with the air cap as the air cap is rotated, thereby preventing light from the first and second plurality of lights from being blocked by the spray plume.

18. The spray gun light of claim 17, wherein:

the first plurality of lights are arranged together in a pattern; and the second plurality of lights are arranged together in the pattern.

19. The spray gun light of claim 18, wherein the pattern comprises:

a straight line;

a curved line;

an arrow;

a square;

a rectangle;

a triangle; or a circle.

* * * * *